US009691193B2

(12) United States Patent
Pandya et al.

(10) Patent No.: US 9,691,193 B2
(45) Date of Patent: Jun. 27, 2017

(54) METHOD FOR SECURELY AUTHORIZING VEHICLE OWNERS TO AN IN-VEHICLE TELEMATICS FEATURE ABSENT IN-CAR SCREEN

(71) Applicant: Ford Global Technologies, LLC, Dearborn, MI (US)

(72) Inventors: Ritesh Pandya, Rochester Hills, MI (US); Brian Petersen, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 394 days.

(21) Appl. No.: 14/054,877

(22) Filed: Oct. 16, 2013

(65) Prior Publication Data

US 2015/0105941 A1 Apr. 16, 2015

(51) Int. Cl.
*G07C 5/00* (2006.01)

(52) U.S. Cl.
CPC ..... *G07C 5/008* (2013.01)

(58) Field of Classification Search
USPC ..... 701/2
See application file for complete search history.

(56) References Cited

U.S. PATENT DOCUMENTS 8,779,947 B2 * 7/2014 Tengler ..... H04W 4/00 307/10.7
8,909,212 B2 * 12/2014 Pandya ..... H04W 4/001 455/418
8,912,883 B2 * 12/2014 Kobres ..... G06Q 10/02 340/5.2
9,252,951 B1 * 2/2016 Katzer ..... G07C 9/00309
2006/0143463 A1 * 6/2006 Ikeda ..... B60R 25/04 713/182
2006/0202799 A1 * 9/2006 Zambo ..... G07C 9/00817 340/5.72
2007/0200671 A1 * 8/2007 Kelley ..... B60R 25/257 340/5.72
2012/0262283 A1 10/2012 Biondo
2013/0339228 A1 * 12/2013 Shuster ..... G06F 9/541 705/40
2014/0156138 A1 * 6/2014 Klaff ..... G06Q 30/0645 701/33.4
2014/0201064 A1 * 7/2014 Jackson ..... G08G 1/0175 705/38
2014/0240086 A1 * 8/2014 Van Wiemeersch .... B60R 25/25 340/5.51

(Continued)

*Primary Examiner* — Jean-Paul Cass
(74) *Attorney, Agent, or Firm* — Jennifer Stec; Brooks Kushman P.C.

(57) ABSTRACT

A system includes a processor configured to receive remote vehicle identification information and a user-confirmable vehicle variable value from a remote vehicle computing system. The processor is also configured to receive vehicle identification information and user-confirmable variable value user-input, input in conjunction with a remote process remote access request. Further, the processor is configured to compare the user-input variable value to the remotely received variable value. The processor is additionally configured to provide access to the remote process upon a correspondence between the user-input variable value and the remotely received variable value.

20 Claims, 3 Drawing Sheets

(56) References Cited

U.S. PATENT DOCUMENTS

| | | | | |
|---|---|---|---|---|
| 2014/0282931 | A1* | 9/2014 | Protopapas | G06F 21/31 726/5 |
| 2015/0066557 | A1* | 3/2015 | Lichti | H04W 4/028 705/7.15 |
| 2015/0206206 | A1* | 7/2015 | Puente | G06Q 30/0645 705/307 |
| 2015/0277942 | A1* | 10/2015 | Rork | G06F 8/65 701/31.4 |
| 2015/0281374 | A1* | 10/2015 | Petersen | H04L 67/12 709/223 |
| 2015/0288636 | A1* | 10/2015 | Yalavarty | H04L 51/16 709/206 |
| 2016/0086391 | A1* | 3/2016 | Ricci | G07C 5/008 701/29.3 |
| 2016/0093216 | A1* | 3/2016 | Lee | H04W 4/046 340/870.11 |
| 2016/0096508 | A1* | 4/2016 | Oz | H04L 67/125 701/36 |
| 2016/0098670 | A1* | 4/2016 | Oz | G06Q 30/0641 705/27.1 |
| 2016/0098870 | A1* | 4/2016 | Bergerhoff | G07C 9/00007 340/5.61 |
| 2016/0098871 | A1* | 4/2016 | Oz | G07C 9/00111 340/5.61 |
| 2016/0099927 | A1* | 4/2016 | Oz | H04L 63/08 726/9 |
| 2016/0371788 | A1* | 12/2016 | Rackley, III | G06Q 30/0645 |

* cited by examiner

METHOD FOR SECURELY AUTHORIZING VEHICLE OWNERS TO AN IN-VEHICLE TELEMATICS FEATURE ABSENT IN-CAR SCREEN

TECHNICAL FIELD

The illustrative embodiments generally relate to a method and apparatus for remote device verification.

BACKGROUND

With vehicle computing systems providing support to remote systems in wireless communication, sometimes removed from the vehicle environment, challenges arise in ensuring that these systems cannot be hacked. Since a hacked vehicle can present a viable safety hazard, manufacturers are incentivized to find methodologies to prevent unauthorized remote access to vehicle systems.

On current challenge that exists is that customers may be required to identify and enter a VIN into a website or mobile application in order to access a vehicle system. The cloud can then send a message to a vehicle, to pop up a message within the vehicle for confirmation. A driver can then permit or deny access. Vehicles without screens, or without screens equipped to present this information, may have difficulty enacting this method.

U.S. Application No. 2012/0262283 generally relates to a system and method for providing an odometer verification for a vehicle. The method carried out by the system includes the steps of: (a) receiving authorization from a customer to periodically store odometer information obtained from the customer's vehicle; (b) configuring at least one processing device such that it automatically stores odometer readings and associated correlation parameter values for the vehicle; (c) receiving a request for an odometer verification; (d) analyzing the odometer readings and associated correlation parameter values in response to the request; (e) determining a verification result based on the analysis; and (f) sending the verification result to a recipient in response to the determination.

SUMMARY

In a first illustrative embodiment, a system includes a processor configured to receive remote vehicle identification information and a user-confirmable vehicle variable value from a remote vehicle computing system. The processor is also configured to receive vehicle identification information and user-confirmable variable value user-input, input in conjunction with a remote process remote access request. Further, the processor is configured to compare the user-input variable value to the remotely received variable value. The processor is additionally configured to provide access to the remote process upon a correspondence between the user-input variable value and the remotely received variable value.

In a second illustrative embodiment, a computer-implemented method includes receiving remote vehicle identification information and a user-confirmable vehicle variable value from a remote vehicle computing system. The method also includes receiving vehicle identification information and user-confirmable variable value user-input, input in conjunction with a remote process remote access request. Further, the method includes comparing the user-input variable value to the remotely received variable value. The method additionally includes providing access to the remote process upon a correspondence between the user-input variable value and the remotely received variable value.

In a third illustrative embodiment, a computer-readable storage medium stores instructions that, when executed by a processor, cause the processor to perform a method including receiving remote vehicle identification information and a user-confirmable vehicle variable value from a remote vehicle computing system. The illustrative method also includes receiving vehicle identification information and user-confirmable variable value user-input, input in conjunction with a remote process remote access request. Further, the method includes comparing the user-input variable value to the remotely received variable value and providing access to the remote process upon a correspondence between the user-input variable value and the remotely received variable value.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
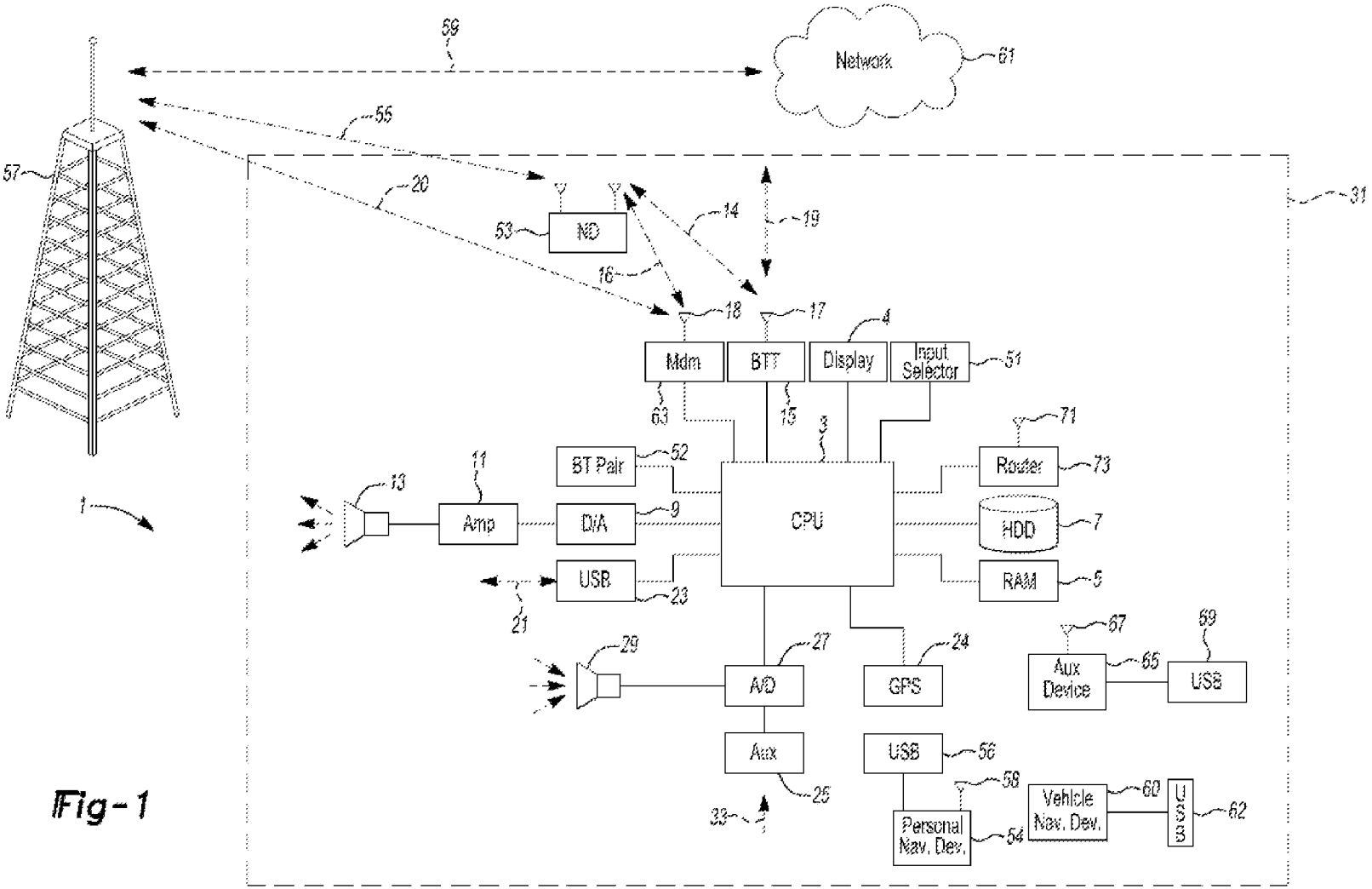
FIG. 1 shows an illustrative vehicle computing system.

FIG. 1 illustrates an example block topology for a vehicle based computing system 1 (VCS) for a vehicle 31. An example of such a vehicle-based computing system 1 is the SYNC system manufactured by THE FORD MOTOR COMPANY. A vehicle enabled with a vehicle-based computing system may contain a visual front end interface 4 located in the vehicle. The user may also be able to interact with the interface if it is provided, for example, with a touch sensitive screen. In another illustrative embodiment, the interaction occurs through, button presses, audible speech and speech synthesis.

In the illustrative embodiment 1 shown in FIG. 1, a processor 3 controls at least some portion of the operation of the vehicle-based computing system. Provided within the vehicle, the processor allows onboard processing of commands and routines. Further, the processor is connected to both non-persistent 5 and persistent storage 7. In this illustrative embodiment, the non-persistent storage is random access memory (RAM) and the persistent storage is a hard disk drive (HDD) or flash memory.

The processor is also provided with a number of different inputs allowing the user to interface with the processor. In this illustrative embodiment, a microphone 29, an auxiliary input 25 (for input 33), a universal serial bus (USB) input 23, a global positioning system (GPS) input 24 and a BLUETOOTH input 15 are all provided. An input selector 51 is also provided, to allow a user to swap between various inputs. Input to both the microphone and the auxiliary connector is converted from analog to digital by a converter 27 before being passed to the processor. Although not shown, numerous of the vehicle components and auxiliary components in communication with the VCS may use a vehicle network (such as, but not limited to, a controller area network (CAN) bus) to pass data to and from the VCS (or components thereof).

Outputs to the system can include, but are not limited to, a visual display 4 and a speaker 13 or stereo system output. The speaker is connected to an amplifier 11 and receives its signal from the processor 3 through a digital-to-analog converter 9. Output can also be made to a remote BLUETOOTH device such as personal navigation device (PND) 54 or a USB device such as vehicle navigation device 60 along the bi-directional data streams shown at 19 and 21 respectively.

In one illustrative embodiment, the system 1 uses the BLUETOOTH transceiver 15 to communicate 17 with a user's nomadic device 53 (e.g., cell phone, smart phone, personal digital assistant (PDA), or any other device having wireless remote network connectivity). The nomadic device can then be used to communicate 59 with a network 61 outside the vehicle 31 through, for example, communication 55 with a cellular tower 57. In some embodiments, tower 57 may be a WiFi access point.

Exemplary communication between the nomadic device and the BLUETOOTH transceiver is represented by signal 14.

Pairing a nomadic device 53 and the BLUETOOTH transceiver 15 can be instructed through a button 52 or similar input. Accordingly, the central processing unit (CPU) is instructed that the onboard BLUETOOTH transceiver will be paired with a BLUETOOTH transceiver in a nomadic device.

Data may be communicated between CPU 3 and network 61 utilizing, for example, a data-plan, data over voice, or dual-tone multi-frequency (DTMF) tones associated with nomadic device 53. Alternatively, it may be desirable to include an onboard modem 63 having antenna 18 in order to communicate 16 data between CPU 3 and network 61 over the voice band. The nomadic device 53 can then be used to communicate 59 with a network 61 outside the vehicle 31 through, for example, communication 55 with a cellular tower 57. In some embodiments, the modem 63 may establish communication 20 with the tower 57 for communicating with network 61. As a non-limiting example, modem 63 may be a USB cellular modem and communication 20 may be cellular communication.

In one illustrative embodiment, the processor is provided with an operating system including an API to communicate with modem application software. The modem application software may access an embedded module or firmware on the BLUETOOTH transceiver to complete wireless communication with a remote BLUETOOTH transceiver (such as that found in a nomadic device). Bluetooth is a subset of the IEEE 802 PAN (personal area network) protocols. IEEE 802 LAN (local area network) protocols include WiFi and have considerable cross-functionality with IEEE 802 PAN. Both are suitable for wireless communication within a vehicle. Another communication means that can be used in this realm is free-space optical communication (such as infrared data association (IrDA)) and non-standardized consumer infrared (IR) protocols.

In another embodiment, nomadic device 53 includes a modem for voice band or broadband data communication. In the data-over-voice embodiment, a technique known as frequency division multiplexing may be implemented when the owner of the nomadic device can talk over the device while data is being transferred. At other times, when the owner is not using the device, the data transfer can use the whole bandwidth (300 Hz to 3.4kHz in one example). While frequency division multiplexing may be common for analog cellular communication between the vehicle and the internet, and is still used, it has been largely replaced by hybrids of with Code Domian Multiple Access (CDMA), Time Domain Multiple Access (TDMA), Space-Domian Multiple Access (SDMA) for digital cellular communication. These are all ITU IMT-2000 (3G) compliant standards and offer data rates up to 2 mbs for stationary or walking users and 385 kbs for users in a moving vehicle. 3G standards are now being replaced by IMT-Advanced (4G) which offers 100 mbs for users in a vehicle and 1 gbs for stationary users.

If the user has a data-plan associated with the nomadic device, it is possible that the data-plan allows for broad-band transmission and the system could use a much wider bandwidth (speeding up data transfer). In still another embodiment, nomadic device 53 is replaced with a cellular communication device (not shown) that is installed to vehicle 31. In yet another embodiment, the ND 53 may be a wireless local area network (LAN) device capable of communication over, for example (and without limitation), an 802.11g network (i.e., WiFi) or a WiMax network.

In one embodiment, incoming data can be passed through the nomadic device via a data-over-voice or data-plan, through the onboard BLUETOOTH transceiver and into the vehicle's internal processor 3. In the case of certain temporary data, for example, the data can be stored on the HDD or other storage media 7 until such time as the data is no longer needed.

Additional sources that may interface with the vehicle include a personal navigation device 54, having, for example, a USB connection 56 and/or an antenna 58, a vehicle navigation device 60 having a USB 62 or other connection, an onboard GPS device 24, or remote navigation system (not shown) having connectivity to network 61. USB is one of a class of serial networking protocols. IEEE 1394 (firewire), EIA (Electronics Industry Association) serial protocols, IEEE 1284 (Centronics Port), S/PDIF (Sony/Philips Digital Interconnect Format) and USB-IF (USB Implementers Forum) form the backbone of the device-device serial standards. Most of the protocols can be implemented for either electrical or optical communication.

Further, the CPU could be in communication with a variety of other auxiliary devices 65. These devices can be connected through a wireless 67 or wired 69 connection. Auxiliary device 65 may include, but are not limited to, personal media players, wireless health devices, portable computers, and the like.

Also, or alternatively, the CPU could be connected to a vehicle based wireless router 73, using for example a WiFi 71 transceiver. This could allow the CPU to connect to remote networks in range of the local router 73.

In addition to having exemplary processes executed by a vehicle computing system located in a vehicle, in certain embodiments, the exemplary processes may be executed by a computing system in communication with a vehicle computing system. Such a system may include, but is not limited to, a wireless device (e.g., and without limitation, a mobile phone) or a remote computing system (e.g., and without limitation, a server) connected through the wireless device. Collectively, such systems may be referred to as vehicle associated computing systems (VACS). In certain embodiments particular components of the VACS may perform particular portions of a process depending on the particular implementation of the system. By way of example and not limitation, if a process has a step of sending or receiving information with a paired wireless device, then it is likely that the wireless device is not performing the process, since the wireless device would not "send and receive" information with itself. One of ordinary skill in the art will understand when it is inappropriate to apply a particular VACS to a given solution. In all solutions, it is contemplated that at least the vehicle computing system (VCS) located within the vehicle itself is capable of performing the exemplary processes.

In the illustrative embodiments, a customer may enter a vehicle identification number (VIN) through a mobile application or website attempting to obtain access to the vehicle or communicate with the vehicle. Then, the user will be instructed to power the vehicle (if it is not already powered). When the vehicle is powered, it can send location information, odometer information, or any other appropriate information to the cloud.

The customer can then input information corresponding to the sent information. This information can be, for example, any information obtainable to a user with vehicle access (e.g., without limitation, odometer, fuel gauge, or any other information obtainable from a viewable vehicle system. If this information matches the sent vehicle information, the user is considered as verified in possession of the vehicle (and thus appropriately requesting access).

Figure 2:
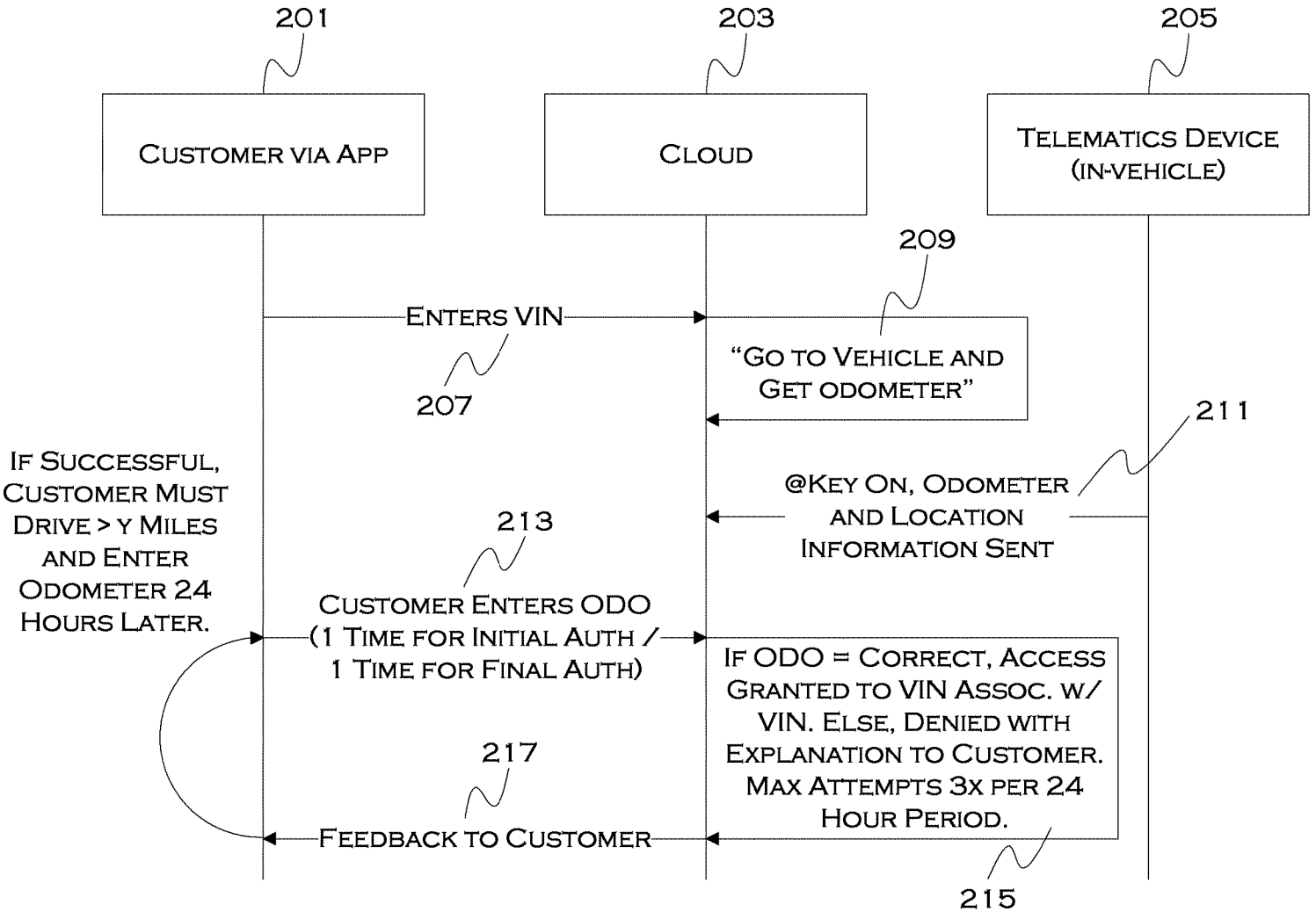
FIG. 2 shows an illustrative example of a device or application approval process.

FIG. 2 shows an illustrative example of a device or application approval process. In this illustrative example, three elements of the vehicle system exist, including, but not limited to, a customer (via an application, website, etc.) 201, the cloud 203 (e.g., a remote computing system in wireless communication with the application/website and the vehicle, a telematics device or other vehicle based computing system 205.

First, in this example, the customer will input a VIN or other unique vehicle identifier 207. This information can be used to identify sent vehicle information from an online repository of information. The remote server which receives the VIN, can then request appropriate vehicle information (in this case, the odometer) 209. Additionally or alternatively, the information can be automatically sent each time the vehicle is powered and has access to the cloud 211.

To verify that the customer is rightfully requesting vehicle access, the customer will be asked to enter the information corresponding to the vehicle information sent to the cloud 213. In this case, the customer will be asked to enter vehicle odometer information, although any vehicle information that is usable to identify a vehicle and usable to verify that a vehicle was actually physically accessed may be used.

If the input information is correct, the process will grant access to the vehicle 215. For example, in this case, the customer will be provided with access for a limited period of time until a more robust improvement process can be performed. Feedback, in the form of verification, approval or denial can also be provided to a driver 217.

Figure 3A:
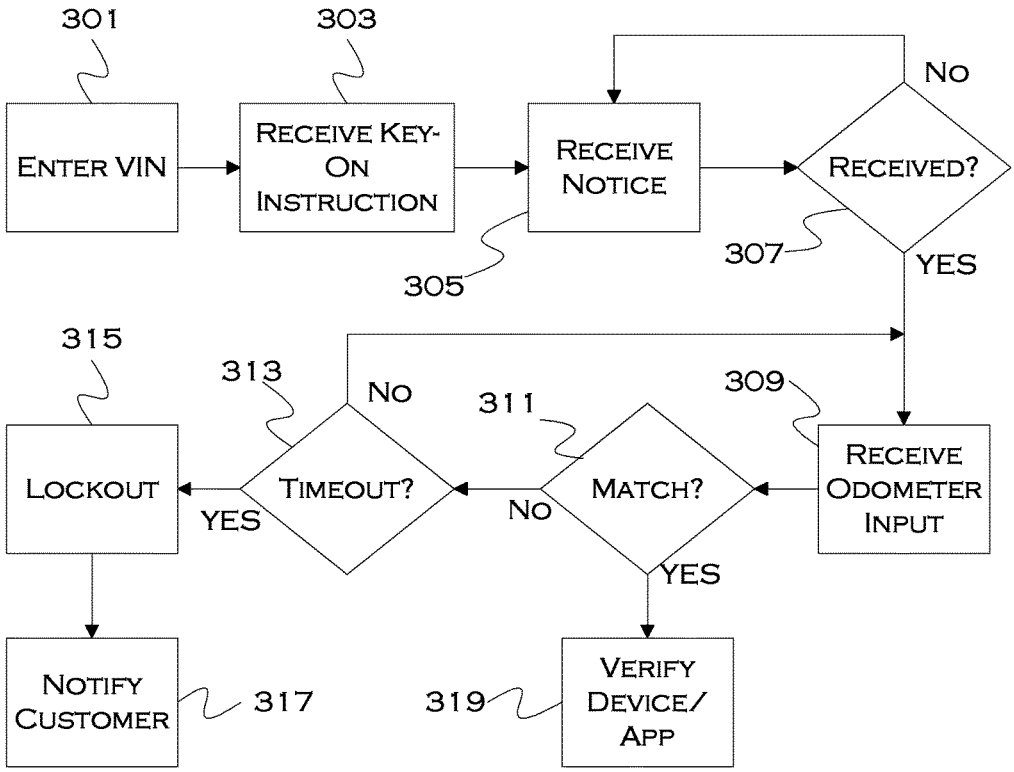
FIG. 3A shows an illustrative example of a user entry process.

FIG. 3A shows an illustrative example of a user entry process. In this example, the user first accesses an application or other website that is designed to communicate with a vehicle computing system. To prevent hacking of the vehicle, some form of identification is desired. First, in this instance, to identify the particular vehicle, the user enters a VIN 301.

Since information from the vehicle is required in this example, the process will instruct the user to power the vehicle so that the information can be transferred 303. If the vehicle is already powered or has sent information since the VIN was input, the request may be avoided.

Once the vehicle is powered and/or the vehicle has attempted communication with the server, a notice of vehicle communication will be received 305. Once this information is actually received 307 (which includes vehicle-sent identifying information), the process will request or receive the odometer (fuel level, current radio station, or other identifying variable) input 309 from the user. This input information is then compared to the received notice information from the vehicle, and a match state is determined 311.

If there is a match, the process will verify the user as an acceptable user 319. If the match is not present, the process will check to see if a maximum time-limit and/or number of attempts has been exceeded 313. If the timeout period/attempts have been exceeded, the process will lock the user out from the vehicle for a suitable time period 315. A notification can also be sent to a customer at this point 317, which can be used to alert the customer that a failed attempt to access the vehicle has occurred.

Figure 3B:
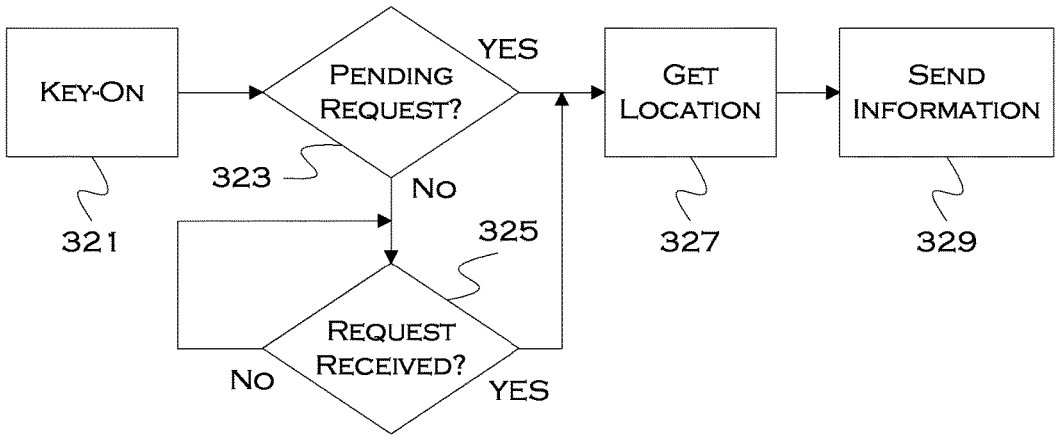
FIG. 3B shows an illustrative example of a vehicle verification process.

FIG. 3B shows an illustrative example of a vehicle verification process. In this illustrative example, the vehicle only sends information to a remote server when a pending request for the information is present. Upon vehicle key-on 321, the process checks to see if a request is pending 323. If there is no pending request, the process may spool until a request is received 325.

Once a request is received, the process will obtain vehicle location information and any other relevant vehicle system information 327. Any appropriate information usable to associate a user with a vehicle, along with vehicle identifying information (such as a VIN), may be sent to the remote server 329.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system comprising:

a processor configured to:

receive remote vehicle identification information and a user-confirmable vehicle-system variable value from a remote vehicle computing system;

receive vehicle identification information and user-confirmable variable value user-input, input in conjunction with a remote process remote access request;

compare the user-input variable value to the remotely received variable value; and provide access to the remote process upon a correspondence between the user-input variable value and the remotely received variable value.

2. The system of claim 1, wherein the user-confirmable vehicle variable value includes an odometer value.

3. The system of claim 1, wherein the user-confirmable vehicle variable value includes a current fuel level.

4. The system of claim 1, wherein the user-confirmable vehicle variable value includes a current radio station setting.

5. The system of claim 1, wherein the remote process includes a website attempting to access the vehicle.

6. The system of claim 1, wherein the remote process includes a device application attempting to access the vehicle.

7. The system of claim 1, wherein the provided access includes a temporal expiration.

8. A computer-implemented method comprising:

receiving remote vehicle identification information and a user-confirmable vehicle-system variable value from a remote vehicle computing system;

receiving vehicle identification information and user-confirmable variable value user-input, input in conjunction with a remote process remote access request;

comparing the user-input variable value to the remotely received variable value; and providing access to the remote process upon a correspondence between the user-input variable value and the remotely received variable value.

9. The method of claim 8, wherein the user-confirmable vehicle variable value includes an odometer value.

10. The method of claim 8, wherein the user-confirmable vehicle variable value includes a current fuel level.

11. The method of claim 8, wherein the user-confirmable vehicle variable value includes a current radio station setting.

12. The method of claim 8, wherein the remote process includes a website attempting to access the vehicle.

13. The method of claim 8, wherein the remote process includes a device application attempting to access the vehicle.

14. The method of claim 8, wherein the provided access includes a temporal expiration.

15. A computer-readable storage medium, storing instructions that, when executed by a processor, cause the processor to perform a method comprising:

receiving remote vehicle identification information and a user-confirmable vehicle-system variable value from a remote vehicle computing system;

receiving vehicle identification information and user-confirmable variable value user-input, input in conjunction with a remote process remote access request;

comparing the user-input variable value to the remotely received variable value; and providing access to the remote process upon a correspondence between the user-input variable value and the remotely received variable value.

16. The storage medium of claim 15, wherein the user-confirmable vehicle variable value includes an odometer value.

17. The storage medium of claim 15, wherein the user-confirmable vehicle variable value includes a current fuel level.

18. The storage medium of claim 15, wherein the user-confirmable vehicle variable value includes a current radio station setting.

19. The storage medium of claim 15, wherein the remote process includes a website attempting to access the vehicle.

20. The storage medium of claim 15, wherein the remote process includes a device application attempting to access the vehicle.

* * * * *